US005709836A

United States Patent [19]

Fujisawa et al.

[11] Patent Number: 5,709,836

[45] Date of Patent: Jan. 20, 1998

[54] CHROMIUM STEEL SHEETS HAVING AN EXCELLENT PRESS FORMABILITY

[75] Inventors: Mitsuyuki Fujisawa; Yasushi Kato; Takumi Ujiro; Susumu Satoh; Koji Yamato, all of Chiba, Japan

[73] Assignee: Kawasaki Steel Corporation, Japan

[21] Appl. No.: 602,857

[22] PCT Filed: Jul. 5, 1995

[86] PCT No.: PCT/JP95/01341

§ 371 Date: Feb. 28, 1996

§ 102(e) Date: Feb. 28, 1996

[87] PCT Pub. No.: WO96/01335

PCT Pub. Date: May 18, 1996

[30] Foreign Application Priority Data

Jul. 5, 1994 [JP] Japan ..... 6-153831

[51] Int. Cl.[6] ..... C22C 38/26; C22C 38/28

[52] U.S. Cl. ..... 420/41; 420/64; 420/68; 420/69; 420/428; 420/583

[58] Field of Search ..... 148/325, 334; 420/41, 64, 68, 69, 70, 106, 110, 111, 428, 583

[56] References Cited

FOREIGN PATENT DOCUMENTS 54-11770 5/1979 Japan .
56-123356 9/1981 Japan .
61-261460 11/1986 Japan .
2-61033 3/1990 Japan .
4-232231 8/1992 Japan .
5-132740 5/1993 Japan .
5-195078 8/1993 Japan .
5-287446 11/1993 Japan .

OTHER PUBLICATIONS

By the 19th Committee in Steelmaking of Japan, Society for the Promotion of Science, "Steel and Alloy Elements (upper)" Feb. 28, 1966 (28.02.1966) Seibundo Shinkosha, p. 223.

By the 19th Committee in Steelmaking of Japan, Society for the Promotion of Science, "Steel and Alloy Elements (lower)" Seibundo Shinkosha, p. 281, Feb. 28, 1966.

*Primary Examiner*—Deborah Yee
*Attorney, Agent, or Firm*—Austin R. Miller

[57] ABSTRACT

A chromium steel sheet having excellent press formability, particularly deep-drawing formability and resistance to secondary work brittleness. The construction is a chromium steel sheet including C: not more than 0.03 wt %, Si: not more than 1.0 wt %, Mn: not more than 1.0 wt %, P: not more than 0.05 wt %, S: not more than 0.015 wt %, Al: not more than 0.10 wt %, N: not more than 0.02 wt %, Cr: 5–60 wt %, Ti: 4(C+N)–0.5 wt %, Nb: 0.003–0.020 wt %, B: 0.0002–0.005 wt %, and, if necessary, one or more selected from Mo: 0.01–5.0 wt %, Ca: 0.0005–0.01 wt % and Se: 0.0005–0.025 wt %, and the balance being Fe and inevitable impurities.

10 Claims, 2 Drawing Sheets

CHROMIUM STEEL SHEETS HAVING AN EXCELLENT PRESS FORMABILITY

TECHNICAL FIELD

This invention relates to chromium steel sheets (inclusive of steel strips) having an excellent press formability, particularly excellent deep-drawing formability and resistance to secondary working brittleness.

BACKGROUND ART

As a typical kind of the chromium steel sheets, ferritic stainless steel sheets are usually produced through steps of hot rolling—annealing of hot rolled sheet—cold rolling—finish annealing after the heating of continuously cast slab.

In general, the thus produced ferritic stainless steel is excellent in the resistance to stress corrosion cracking and is cheap, so that it is widely used to applications such as various kitchenwares, automobile parts and the like. However, the steel is often subjected to a severer deep drawing in the application such as fuel filter casing for automobile and the like, so that there is frequently caused a problem of creating cracks due to secondary working brittleness.

Therefore, there have made many attempts in order to improve the deep-drawing formability and the resistance to secondary working brittleness in the ferritic stainless steel sheets.

For example, JP-B-54-11770 has proposed a production technique of ferritic stainless steel sheets aiming at a high cold workability by addition of Ti, while JP-B-57-55787 has proposed a production technique of ferritic stainless steel sheets aiming at a high Lankford value (hereinafter abbreviated as "r-value") by addition of B. Furthermore, JP-B-2-7391 has proposed a production technique for ferritic stainless steel sheets which limits brittle cracks after deep drawing by addition of Ti and B.

However, these techniques have problems as mentioned below. That is, the brittle cracks are frequently observed at the secondary working after severer deep drawing in the technique disclosed in JP-B-54-11770. Further, the technique disclosed in JP-B-57-55787 is unsuitable for severer deep drawing because the deep drawability is insufficient. And also, the addition of Ti and B is conducted in the technique disclosed in JP-B-2-7391, but either deep drawability or resistance to secondary work brittleness is poor and both the properties are not simultaneously satisfied. Moreover, these techniques have a problem in that the plane anisotropy of r-value (hereinafter abbreviated as "Δr") is not sufficiently improved.

As mentioned above, all of the above techniques improve either the deep-drawing formability or the resistance to secondary work embrittlement, but have the common problem that both the properties are not simultaneously improved. Therefore, the occurrence of brittle cracks in the subsequent secondary working is still a concern after severer deep drawing.

It is, therefore, an object of the invention to provide chromium steel sheets having excellent press formability, particularly deep-drawing formability and resistance to secondary work brittleness.

It is another object of the invention to provide chromium steel sheets having an r-value of not less than 1.5, Δr of not more than 0.3 and a brittle crack creating temperature of not higher than −50° C.

DISCLOSE OF INVENTION

The inventors have made various studies in order to achieve the above objects and found that the deep-drawing formability and the resistance to secondary work brittleness are simultaneously improved and further the ductility of weld portion is improved by controlling the chemical composition of the chromium steel sheet to a proper range, and as a result the invention has been accomplished.

The chromium steel sheet having the above properties has the following construction:

(1) The invention is a chromium steel sheet comprising;
C: not more than 0.03 wt %, Si: not more than 1.0 wt %,
Mn: not more than 1.0 wt %, P: not more than 0.05 wt %,
S: not more than 0.015 wt %, Al: not more than 0.10 wt %,
N: not more than 0.02 wt %, Cr: 5–60 wt %,
Ti: 4(C+N)–0.5 wt %, Nb: 0.003–0.020 wt %,
B: 0.0002–0.005 wt %,
and the balance being Fe and inevitable impurities.

(2) The invention is a chromium steel sheet further containing Mo: 0.01–5.0 wt % in addition to the main ingredient of the above item (1).

(3) The invention is a chromium steel sheet further containing Ca: 0.0005–0.01 wt % in addition to the main ingredient of the above item (1).

(4) The invention is a chromium steel sheet further containing Se: 0.0005–0.025 wt % in addition to the main ingredients of the above item (1).

(5) The invention is a chromium steel sheet further containing Mo: 0.01–5.0 wt % and Ca: 0.0005–0.01 wt % in addition to the main ingredient of the above item (1).

(6) The invention is a chromium steel sheet further containing Mo: 0.01–5.0 wt % and Se: 0.0005–0.025 wt % in addition to the main ingredient of the above item (1).

(7) The invention is a chromium steel sheet further containing Ca: 0.0005–0.01 wt % and Se: 0.0005–0.025 wt % in addition to the main ingredients of the above item (1).

(8) The invention is a chromium steel sheet further containing Mo: 0.01–5.0 wt %, Ca: 0.0005–0.01 wt % and Se: 0.0005–0.025 wt % in addition to the main ingredients of the above item (1).

(9) The invention is a chromium steel sheet wherein Mo content in anyone of the above items (2), (5), (6) and (8) is 0.1–3.0 wt %.

(10) The invention is a chromium steel sheet wherein a relationship between Ti content and Nb content in anyone of the above items (1)–(9) satisfies Ti/Nb≧7.

BEST MODE FOR CARRYING OUT THE INVENTION

Figure 1:
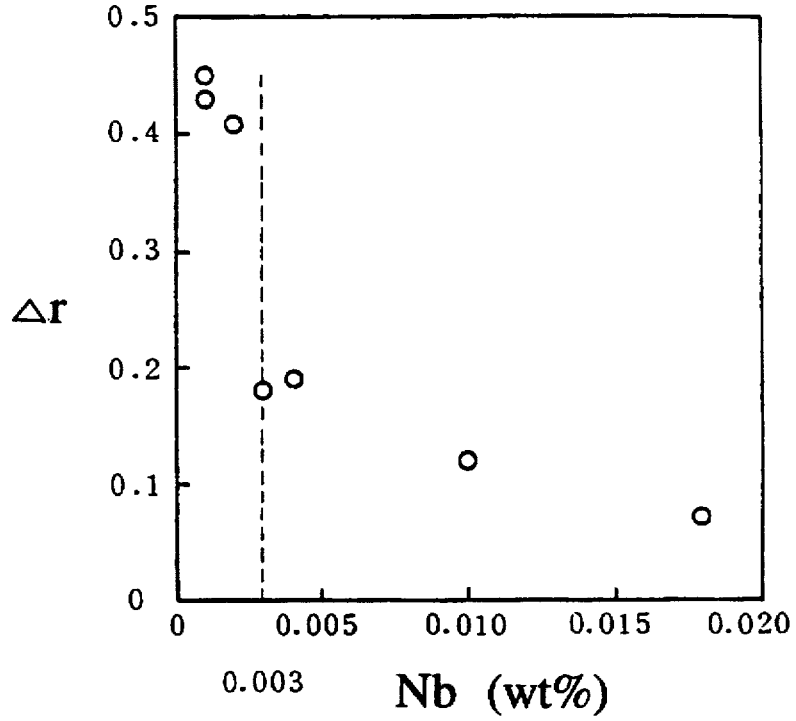
FIG. 1 is a graph showing the influence of Nb content upon Δr.

The preferable conditions for carrying out the invention will be described below.

The chromium steel sheets according to the invention explained in the above item "DISCLOSURE OF INVENTION" are excellent in the press formability, particularly the deep-drawing formability and resistance to secondary work brittleness, and satisfy the r-value of not less than 1.5, the Δr of not more than 0.3 and the brittle crack creating temperature of not higher than −50° C.

The action of each ingredient element and the reason on the numerical limitation in the invention will be described below.

C: not more than 0.03 wt %;

C is an element lowering the r-value and elongation property. Particularly, when it exceeds 0.03 wt %, the influence is conspicuous, so that the content is necessary to be not more than 0.03 wt %. Preferably, it is not more than 0.01 wt %.

Si: not more than 1.0 wt %;

Si is an element effective for deoxidation. The excessive addition brings about the degradation of the cold workability, so that the addition range is not more than 1.0 wt %, preferably not more than 0.5 wt %.

Mn: not more than 1.0 wt %;

Mn is an element effective for precipitating and fixing S existent in the steel to maintain the hot rolling property. The excessive addition brings about the degradation of the cold workability, so that the addition range is not more than 1.0 wt %, preferably not more than 0.5 wt %.

P: not more than 0.05 wt %;

P is an element harmful for hot workability. Particularly, when it exceeds 0.05 wt %, the influence becomes conspicuous, so that the content is not more than 0.05 wt %, preferably not more than 0.04 wt %.

S: not more than 0.015 wt %;

S segregates in a crystal grain boundary to promote grain boundary brittleness and is a harmful element. Particularly, when it exceeds 0.015 wt %, the influence becomes conspicuous, so that the content is not more than 0.015 wt %, preferably not more than 0.008 wt %.

Al: not more than 0.10 wt %;

Al is an element effective for deoxidation. The excessive addition brings about the surface defect due to the increase of Al inclusions, so that the content is not more than 0.10 wt %, preferably not more than 0.07 wt %.

N: not more than 0.02 wt %;

N is an element harmful for the deep-drawing formability likewise C. Particularly, when it exceeds 0.02 wt %, the influence becomes conspicuous, so that the content is necessary to be not more than 0.02 wt %. Preferably, it is not more than 0.01 wt %.

Cr: 5–60 wt %;

Cr is an element necessary for ensuring the corrosion resistance as the stainless steel. When the content is less than 5 wt %, the corrosion resistance is lacking, while when it exceeds 60 wt %, the cold workability is degraded, so that the addition range is 5–60 wt %, preferably 10–45 wt %.

Ti: 4(C+N)–0.5 wt %;

Ti is an element useful for precipitating and fixing C, N harmful for deep-drawing formability to ensure highly deep-drawing formability. The effect is not obtained in an amount of less than 4(C+N) wt %, while the effect is saturated and the productivity lowers when it exceeds 0.5 wt %. Therefore, the addition amount of Ti is 4(C+N)–0.5 wt %, preferably 4(C+N)–0.3 wt %.

Nb: 0.003–0.020 wt %;

Nb is an element particularly important for simultaneously improving the deep-drawing formability and the resistance to secondary work brittleness by composite addition with Ti, B and the like in the invention. The effect is not obtained in an amount of less than 0.003 wt %, while the effect is saturated and the production cost is rather increased when it exceeds 0.020 wt %. The addition amount of Nb is 0.003–0.020 wt %, preferably 0.004–0.018 wt %.

The effect of Nb on the deep-drawing formability and the resistance to secondary work brittleness is explained in detail with reference to the figures. FIG. 1 shows the influence of Nb on Δr in a cold rolled steel sheet (cold reduction through work rolls having a roll diameter of not less than 150 mm: 82.5%) containing (0.007–0.009)wt % C-(0.3–0.4)wt % Si-(0.3–0.4)wt % Mn-(0.02–0.03)wt % P-(0.005–0.007)wt % S-(0.02–0.03)wt % Al-(0.0070–0.0090)wt % N-(16–18)wt % Cr-(0.15–0.17)wt % Ti-(0.0008–0.0010)wt % B. From FIG. 1, it is apparent that Δr is considerably improved by adding Nb of not less than 0.003 wt % and hence the edge shape after the deep drawing is largely improved.

Figure 2:
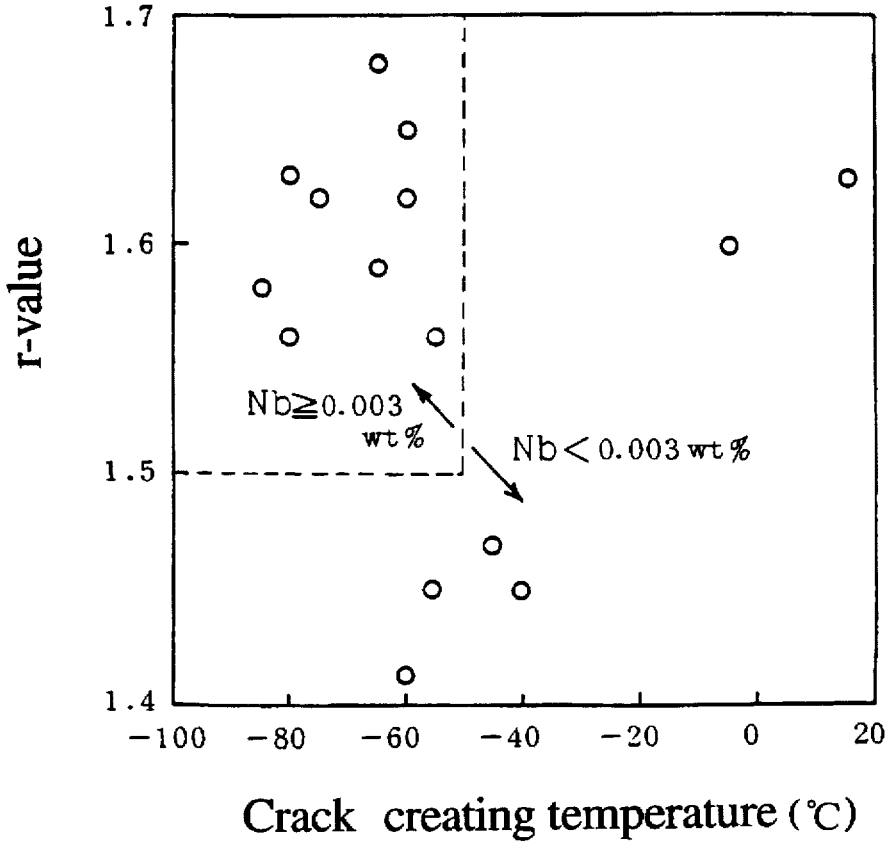
FIG. 2 is a graph showing the relationship between r-value and crack creating temperature.

Further, FIG. 2 shows the influence of Nb amount upon the relationship between brittle cracking and r-value after secondary working of a cold rolled steel sheet (cold reduction through work rolls having a roll diameter of not less than 150 mm: 82.5%) containing (0.007–0.009)wt % C-(0.3–0.4)wt % Si-(0.3–0.4)wt % Mn-(0.02–0.03) wt % P-(0.005–0. 007) wt % S-(0.02–0.03) wt % Al-(0.0070–0.0090)wt % N-(16–18)wt % Cr-(0.15–0.17)wt % Ti-(0.001–0.018)wt % Nb-(0.0008–0.0010)wt % B. From FIG. 2, it is apparent that the steel sheets containing not less than 0.003 wt % of Nb are high in the r-value as a forming limit indication in the deep drawing and low in the brittle crack creating temperature.

As mentioned above, both the deep-drawing formability and the resistance to secondary work brittleness are shown to be balanced at a high level by including not less than 0.003 wt % of Nb.

Ti/Nb≧7

The press formability is improved by composite addition of Ti and Nb instead of single addition. Particularly, Δr is considerably small when Ti and Nb are added together, which acts to considerably improve the press formability. This effect can more surely be attained by the composite addition of Ti and Nb under a condition satisfying Ti/Nb≧7.

B: 0.0002–0.005 wt %;

B is an element effective for improving the resistance to secondary work brittleness after the deep drawing. The effect is not obtained in an amount of less than 0.0002 wt %, while the excessive addition degrades the deep-drawing formability. The addition amount is 0.0002–0.005 wt %, preferably 0.0003–0.003 wt %.

Mo: 0.01–5.0 wt %, preferably 0.1–3.0 wt %;

Mo is an element improving the press formability (r-value, Δr, resistance to secondary work brittleness) and the corrosion resistance, and is added selectively. The improvement of r-value and Δr by the addition of Mo is due to the fact that the recrystallization grain elongation rate is near to 1 together with the fine formation of recrystallization grains in the annealed sheet. The effect is obtained in an amount of not less than 0.01 wt %, but the addition exceeding 5.0 wt % brings about the degradation of deep-drawing formability, so that the addition amount of Mo is 0.01–5.0 wt %. Moreover, the preferable addition amount is 0.1–3.0 wt %.

Ca: 0.0005–0.01 wt %

Ca is an element having an effect of controlling nozzle clogging with Ti inclusion in the steel making and casting and is selectively added in accordance with the Ti content. However, when Ca is excessively added, Ca inclusion is a starting point of brittle breakage, so that the addition range of Ca is 0.0005–0.01 wt %, preferably 0.0005–0.006 wt %.

Se: 0.0005–0.025 wt %

Se is an important element enhancing the flowability of welded metal in the welding to control surface defects (cracking) of weld portions and improve the ductility of the weld portions. This effect appears in an amount of not less than 0.0005 wt %, but when it exceeds 0.025 wt %, the corrosion resistance lowers, so that the addition range of Se is 0.0005–0.025 wt %, preferably 0.0008–0.010 wt %.

The object of the invention is attained by the above chemical ingredients, but the effect of the invention is not lost even if 0.01–0.5 wt % of V, 0.3–6 wt % of Ni, 0.3–6 wt % of Co, 0.1–3 wt % of Cu, 0.3–6 wt % of W are added in addition to these ingredients.

The production of the steel sheet according to the invention may be carried out by a method wherein steel having the above chemical composition is melted in a usual steel-making furnace such as a convertor, electric furnace or the like, shaped into a steel slab by continuous casting process or steel ingot process, and then subjected to hot rolling—(annealing of hot rolled sheet)—pickling—cold rolling—annealing of cold rolled sheet—pickling—if necessary, repetition of cold rolling—annealing—pickling.

However, the object can more advantageously be attained when the rolls diameter of cold rolling work roll and the reduction of cold rolling are controlled to roll diameters of: not less than 150 mm, preferably 250–1000 mm, and reduction: not less than 30%, preferably 40–95% among cold rolling conditions in the above cold rolling step. That is, the cold rolled stainless steel sheet is generally rolled through work rolls having a roll diameter of not more than 100 mm. When the roll diameter is made larger as mentioned above, the shearing stress in the rolling direction through friction between the roll and the steel sheet surface is mitigated and also the difference of stress in the sheet surface becomes small. As a result, the r-value and Δr can be more improved without degrading the resistance to secondary work brittleness. In this case, when the roll diameter is less than 150 mm, or when the reduction is less than 30% even if the roll diameter is not less than 150 mm, the effect is insufficient, while when the roll diameter exceeds 1000 mm, the power required for driving such a roll becomes excessive and economically disadvantageous, and if the reduction through this roll exceeds 95%, the surface properties tend to be degraded due to the sticking between the roll and the steel sheet.

EMBODIMENTS

EXAMPLE 1

A steel having a chemical composition as shown in Tables 1, 2, and 3 is melted in a convertor and rendered into a steel slab through secondary refining, which was heated to 1250° C. and hot rolled to obtain a hot rolled sheet having a thickness of 4.0 mm. The hot rolled sheet was subjected to annealing of hot rolled sheet (800°–950°)—pickling—cold rolling—annealing of cold rolled sheet (800°–950° C.)—pickling to obtain a cold rolled steel sheet having a thickness of 0.7 mm.

The deep-drawing formability (r-value, Δr) and the resistance to secondary work brittleness were measured with respect to the steel sheets obtained by the above method as a test specimen, and the ductility of weld portion was measured with respect to a part of the steel sheets according to the following method.

TABLE 1

| | Chemical composition (wt %) | | | | | | | | | | | | | | | |
|---|---|---|---|---|---|---|---|---|---|---|---|---|---|---|---|---|
| Steel | C | Si | Mn | P | S | AL | N | Cr | Ti | Nb | B | Ca | Mo | 4(C + N) | Ti/Nb | Remarks |
| 1 | 0.011 | 0.43 | 0.46 | 0.032 | 0.004 | 0.030 | 0.0115 | 11.2 | 0.153 | 0.005 | 0.0006 | 0.0015 | — | 0.0900 | 31 | Accept- |
| 2 | 0.010 | 0.21 | 0.32 | 0.037 | 0.006 | 0.025 | 0.0091 | 10.9 | 0.206 | 0.012 | 0.0008 | — | — | 0.0764 | 17 | able |
| 3 | 0.010 | 0.39 | 0.28 | 0.021 | 0.008 | 0.031 | 0.0081 | 16.7 | 0.103 | 0.008 | 0.0004 | 0.0023 | — | 0.0724 | 13 | Examples |
| 4 | 0.014 | 0.62 | 0.19 | 0.018 | 0.005 | 0.046 | 0.0088 | 16.9 | 0.151 | 0.017 | 0.0005 | 0.0018 | — | 0.0912 | 9 | |
| 5 | 0.014 | 0.20 | 0.26 | 0.017 | 0.011 | 0.002 | 0.0072 | 17.3 | 0.161 | 0.003 | 0.0011 | 0.0006 | 0.13 | 0.0848 | 54 | |
| 6 | 0.009 | 0.18 | 0.30 | 0.019 | 0.005 | 0.025 | 0.0066 | 17.0 | 0.149 | 0.010 | 0.0008 | — | 0.98 | 0.0624 | 15 | |
| 7 | 0.010 | 0.31 | 0.15 | 0.029 | 0.004 | 0.001 | 0.0076 | 16.8 | 0.152 | 0.018 | 0.0015 | 0.0030 | — | 0.0704 | 8 | |
| 8 | 0.007 | 0.15 | 0.56 | 0.029 | 0.013 | 0.031 | 0.0085 | 17.2 | 0.093 | 0.004 | 0.0025 | 0.0041 | 0.31 | 0.0620 | 23 | |
| 9 | 0.012 | 0.20 | 0.23 | 0.030 | 0.004 | 0.029 | 0.0034 | 17.0 | 0.131 | 0.009 | 0.0040 | 0.0020 | — | 0.0616 | 15 | |
| 10 | 0.010 | 0.20 | 0.17 | 0.024 | 0.007 | 0.038 | 0.0088 | 16.5 | 0.283 | 0.006 | 0.0010 | 0.0053 | — | 0.0752 | 37 | |
| 11 | 0.015 | 0.19 | 0.42 | 0.018 | 0.006 | 0.056 | 0.0089 | 17.2 | 0.309 | 0.013 | 0.0008 | 0.0080 | — | 0.0956 | 24 | |
| 12 | 0.006 | 0.23 | 0.15 | 0.023 | 0.002 | 0.023 | 0.0063 | 30.5 | 0.103 | 0.007 | 0.0004 | — | — | 0.0492 | 15 | |
| 13 | 0.002 | 0.32 | 0.19 | 0.042 | 0.002 | 0.007 | 0.0071 | 39.2 | 0.162 | 0.015 | 0.0015 | 0.0015 | — | 0.0364 | 11 | |
| 14 | 0.007 | 0.17 | 0.13 | 0.020 | 0.002 | 0.013 | 0.0090 | 51.3 | 0.125 | 0.010 | 0.0007 | 0.0021 | — | 0.0640 | 13 | |
| 15 | 0.011 | 0.26 | 0.21 | 0.019 | 0.004 | 0.011 | 0.0073 | 17.0 | 0.231 | 0.005 | 0.0006 | 0.0010 | 2.56 | 0.0732 | 46 | |
| 16 | 0.005 | 0.31 | 0.25 | 0.020 | 0.005 | 0.009 | 0.0081 | 30.0 | 0.119 | 0.010 | 0.0009 | 0.0019 | 0.79 | 0.0524 | 12 | |

TABLE 2

| Steel | C | Si | Mn | P | S | AL | N | Cr | Ti | Nb | B | Ca | Mo | Se | 4(C + N) | Ti/Nb | Remarks |
|---|---|---|---|---|---|---|---|---|---|---|---|---|---|---|---|---|---|
| | Chemical composition (wt %) | | | | | | | | | | | | | | | | |
| 17 | 0.007 | 0.30 | 0.30 | 0.021 | 0.005 | 0.020 | 0.0076 | 7.0 | 0.153 | 0.011 | 0.0009 | 0.0010 | — | — | 0.0608 | 14 | Accept- |
| 18 | 0.005 | 0.23 | 0.23 | 0.018 | 0.005 | 0.006 | 0.0103 | 11.3 | 0.153 | 0.009 | 0.0011 | — | 0.02 | — | 0.0612 | 17 | able |
| 19 | 0.010 | 0.10 | 0.18 | 0.023 | 0.009 | 0.030 | 0.0073 | 11.1 | 0.224 | 0.015 | 0.0009 | — | 0.21 | — | 0.0692 | 15 | Examples |
| 20 | 0.008 | 0.35 | 0.40 | 0.011 | 0.006 | 0.028 | 0.0059 | 18.0 | 0.126 | 0.010 | 0.0020 | — | 0.03 | — | 0.0556 | 13 | |
| 21 | 0.020 | 0.26 | 0.26 | 0.030 | 0.008 | 0.035 | 0.0121 | 17.9 | 0.253 | 0.015 | 0.0015 | — | 2.11 | — | 0.1284 | 17 | |
| 22 | 0.009 | 0.22 | 0.30 | 0.019 | 0.007 | 0.022 | 0.0054 | 30.2 | 0.103 | 0.007 | 0.0013 | — | 0.04 | — | 0.0576 | 15 | |
| 23 | 0.005 | 0.25 | 0.15 | 0.026 | 0.006 | 0.015 | 0.0103 | 30.3 | 0.159 | 0.015 | 0.0006 | — | 0.53 | — | 0.0612 | 11 | |
| 24 | 0.016 | 0.19 | 0.41 | 0.026 | 0.007 | 0.030 | 0.0083 | 18.0 | 0.162 | 0.011 | 0.0013 | — | 0.05 | 0.0013 | 0.0972 | 15 | |
| 25 | 0.015 | 0.23 | 0.26 | 0.030 | 0.005 | 0.016 | 0.0099 | 17.9 | 0.190 | 0.009 | 0.0009 | — | 2.03 | 0.0025 | 0.0996 | 21 | |
| 26 | 0.009 | 0.19 | 0.22 | 0.028 | 0.005 | 0.017 | 0.0039 | 17.6 | 0.151 | 0.006 | 0.0018 | 0.0015 | — | 0.0023 | 0.0516 | 25 | |
| 27 | 0.005 | 0.26 | 0.31 | 0.015 | 0.004 | 0.011 | 0.0041 | 18.2 | 0.126 | 0.009 | 0.0020 | 0.0020 | 0.03 | 0.0011 | 0.0364 | 14 | |
| 28 | 0.009 | 0.10 | 0.11 | 0.030 | 0.006 | 0.009 | 0.0093 | 18.0 | 0.181 | 0.015 | 0.0007 | 0.0010 | 1.84 | 0.0052 | 0.0732 | 12 | |
| 29 | 0.011 | 0.36 | 0.38 | 0.022 | 0.006 | 0.023 | 0.0086 | 16.9 | 0.201 | 0.007 | 0.0011 | — | — | 0.0008 | 0.0784 | 29 | |
| 30 | 0.009 | 0.33 | 0.29 | 0.028 | 0.005 | 0.022 | 0.0043 | 17.0 | 0.180 | 0.006 | 0.0008 | 0.0009 | 2.12 | 0.0029 | 0.0532 | 30 | |
| 31 | 0.011 | 0.36 | 0.41 | 0.022 | 0.006 | 0.023 | 0.0080 | 11.0 | 0.153 | 0.009 | 0.0013 | — | — | 0.0013 | 0.0760 | 17 | |

TABLE 3

| Steel | C | Si | Mn | P | S | AL | N | Cr | Ti | Nb | B | Ca | Mo | 4(C + N) | Ti/Nb | Remarks |
|---|---|---|---|---|---|---|---|---|---|---|---|---|---|---|---|---|
| | Chemical composition (wt %) | | | | | | | | | | | | | | | |
| 32 | 0.017 | 0.25 | 0.42 | 0.025 | 0.007 | 0.051 | 0.0086 | 11.0 | 0.142 | 0.001 | 0.0007 | 0.0023 | — | 0.1024 | 142 | Compara- |
| 33 | 0.013 | 0.41 | 0.19 | 0.028 | 0.004 | 0.026 | 0.0060 | 16.8 | 0.128 | 0.001 | 0.0001 | 0.0023 | — | 0.0760 | 128 | tive |
| 34 | 0.015 | 0.23 | 0.25 | 0.019 | 0.004 | 0.030 | 0.0073 | 17.0 | 0.133 | 0.001 | 0.0003 | 0.0018 | — | 0.0892 | 133 | Examples |
| 35 | 0.011 | 0.36 | 0.31 | 0.023 | 0 005 | 0.005 | 0.0088 | 17.1 | 0.129 | 0.002 | 0.0010 | — | 0.13 | 0.0792 | 129 | |
| 36 | 0.009 | 0.25 | 0.26 | 0.022 | 0.008 | 0.032 | 0.0079 | 17.0 | 0.118 | 0.001 | 0.0020 | 0.0053 | — | 0.0676 | 118 | |
| 37 | 0.012 | 0.32 | 0.25 | 0.022 | 0.007 | 0.025 | 0.0056 | 16.9 | 0.283 | 0.001 | 0.0001 | 0.0022 | 1.01 | 0.0704 | 283 | |
| 38 | 0.010 | 0.19 | 0.30 | 0.021 | 0.003 | 0.036 | 0.0091 | 17.3 | 0.309 | 0.001 | 0.0009 | 0.0018 | — | 0.0764 | 309 | |
| 39 | 0.005 | 0.15 | 0.22 | 0.019 | 0.010 | 0.010 | 0.0071 | 30.5 | 0.130 | 0.001 | 0.0009 | 0.0026 | — | 0.0484 | 130 | |
| 40 | 0.006 | 0.18 | 0.22 | 0.026 | 0.002 | 0.025 | 0.0069 | 51.0 | 0.129 | 0.001 | 0.0008 | 0.0017 | — | 0.0516 | 129 | |
| 41 | 0.009 | 0.29 | 0.26 | 0.021 | 0.005 | 0.020 | 0.0083 | 7.1 | 0.143 | 0.001 | 0.0010 | 0.0012 | — | 0.0692 | 142 | |
| 42 | 0.006 | 0.28 | 0.33 | 0.022 | 0.005 | 0.060 | 0.0093 | 17.9 | 0.001 | 0.171 | 0.0009 | — | — | 0.0612 | <1 | |
| 43 | 0.011 | 0.30 | 0.16 | 0.015 | 0.006 | 0.033 | 0.0058 | 18.2 | 0.001 | 0.018 | 0.0011 | — | — | 0.0672 | <1 | |

r-value, $\Delta r$

A test specimen of JIS No. 5 is cut out from the steel sheet in a rolling direction, a direction of 45° with respect to the rolling direction or a direction of 90° with respect to the rolling direction. A uniaxial tensile prestrain of 5–15% is applied to each of these test specimens, during which a Lankford value in each direction is measured from a ratio of lateral strain and thickness strain and calculated according to the following equation:

$$r=(r_L+2r_D+r_T)/4$$

$$\Delta r=(r_L-2r_D+r_T)/2$$

wherein $r_L$, $r_D$ and $r_T$ show Lankford values in the rolling direction, direction of 45° with respect to the rolling direction and direction of 90° with respect to the rolling direction, respectively.

Resistance to secondary work brittleness

A cup-shaped test specimen subjected to deep drawing at a drawing ratio of 2 is held at a particular temperature of −100° C.–20° C., and thereafter an impact load is applied to a head portion of the cup according to a drop weight test (weight: 5 kg, dropping difference: 0.8 m), during which a crack creating temperature is measured from the presence or absence of brittle crack at a sidewall portion of the cup.

In each of all steels, the test is conducted with respect to two specimens for every temperature interval of 5° C. A temperature when brittle cracking is created in one of the two specimens is the crack creating temperature.

Ductility of weld portion

Figure 3:
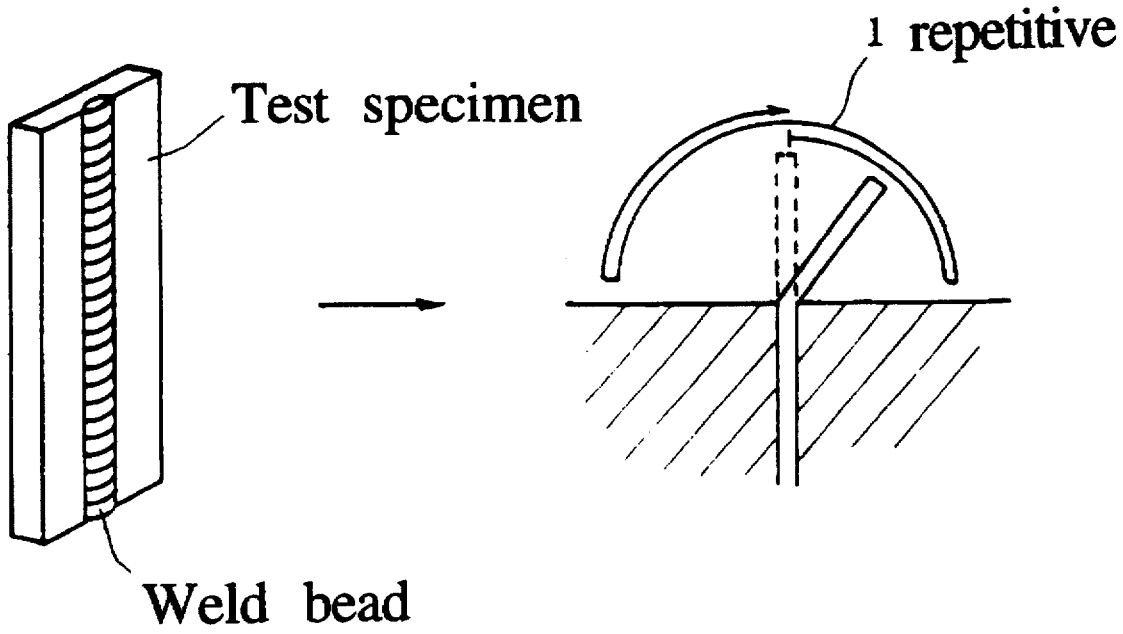
FIG. 3 is a diagrammatical view illustrating a method of repetitive bending test.

The cold rolled steel sheet (thickness: 0.7 mm) is welded through TIG welding method, from which is taken out a strip-shaped test specimen of 15 mm×70 mm arranging a weld portion in center. The test specimen is subjected to a repetitive bending test (see FIG. 3) repeating bending—returning operation 20 times, during which the occurrence of cracking from the weld portion is observed. This test was carried out with respect to 20 specimens of each of the test steels, and the crack creating ratio was measured from the number of cracked specimens.

The test results are shown in Table 4.

TABLE 4

| Steel No | Diameter of cold rolling roll(mm) | r-value | Δr | Crack creating temperature (°C.) | Bending crack of bead (%) | Remarks | Steel No | Diameter of cold rolling roll(mm) | r-value | Δr | Crack creating temperature (°C.) | Bending crack of bead (%) | Remarks |
|---|---|---|---|---|---|---|---|---|---|---|---|---|---|
| 1 | 180 | 1.72 | 0.14 | −70 | — | Accept- | 23 | 180 | 1.82 | 0.03 | −65 | — | Accept- |
| 2 | 180 | 1.76 | 0.11 | −75 | — | able | 24 | 180 | 1.79 | 0.05 | −70 | 0 | able |
| 3 | 180 | 1.65 | 0.12 | −60 | — | Example | 25 | 180 | 1.86 | 0.03 | −70 | 0 | Example |
| 4 | 300 | 1.68 | 0.04 | −65 | — | | 26 | 180 | 1.61 | 0.10 | −65 | 0 | |
| 5 | 180 | 1.63 | 0.09 | −65 | — | | 27 | 180 | 1.81 | 0.06 | −70 | 0 | |
| 6 | 180 | 1.65 | 0.07 | −75 | — | | 28 | 180 | 1.90 | 0.09 | −65 | 0 | |
| 7 | 80 | 1.63 | 0.07 | −80 | — | | 29 | 180 | 1.73 | 0.10 | −60 | 5 | |
| 8 | 180 | 1.59 | 0.10 | −80 | — | | 30 | 180 | 1.69 | 0.15 | −65 | 0 | |
| 9 | 180 | 1.58 | 0.13 | −85 | — | | 31 | 180 | 1.79 | 0.12 | −70 | 0 | |
| 10 | 80 | 1.56 | 0.24 | −55 | — | | 32 | 180 | 1.61 | 0.41 | −60 | — | Compara- |
| 11 | 80 | 1.62 | 0.11 | −60 | — | | 33 | 180 | 1.60 | 0.42 | −5 | — | tive |
| 12 | 180 | 1.53 | 0.14 | −50 | — | | 34 | 80 | 1.47 | 0.45 | −45 | — | Example |
| 13 | 80 | 1.53 | 0.19 | −55 | — | | 35 | 80 | 1.45 | 0.41 | −55 | — | |
| 14 | 180 | 1.55 | 0.14 | −50 | — | | 36 | 80 | 1.41 | 0.43 | −60 | — | |
| 15 | 300 | 1.56 | 0.15 | −55 | — | | 37 | 180 | 1.63 | 0.41 | 15 | — | |
| 16 | 180 | 1.53 | 0.17 | −50 | — | | 38 | 300 | 1.45 | 0.50 | −40 | — | |
| 17 | 180 | 1.73 | 0.11 | −75 | — | | 39 | 180 | 1.38 | 0.43 | −35 | — | |
| 18 | 180 | 1.95 | 0.03 | −75 | — | | 40 | 180 | 1.25 | 0.63 | −25 | — | |
| 19 | 180 | 2.01 | 0.02 | −80 | — | | 41 | 180 | 1.68 | 0.43 | −55 | — | |
| 20 | 180 | 1.80 | 0.04 | −70 | — | | 42 | 180 | 1.28 | 0.50 | −40 | 30 | |
| 21 | 180 | 1.85 | 0.02 | −70 | — | | 43 | 180 | 0.93 | 0.71 | −40 | 30 | |
| 22 | 180 | 1.76 | 0.05 | −65 | — | | | | | | | | |

As seen from Table 4, the steel sheets according to the invention exhibit properties that the r-value is not less than 1.5, Δr is not more than 0.3 and the crack creating temperature indicating the resistance to secondary work brittleness is not higher than −50° C., so that they have excellent deep-drawing formability and resistance to secondary work brittleness as compared to the comparative examples.

Furthermore, in the steel sheets containing Se according to the invention, the cracking ratio of bead is not more than 10% in addition to the above properties.

EXAMPLE 2

Among the steels shown in Table 1, each of steel Nos. 1 and 6 was melted in a convertor and subjected to secondary refining to obtain a steel slab, which was then heated to 1250° C. and hot rolled to obtain a hot rolled sheet having a thickness of 4.0 mm. The hot rolled sheet was rendered into a cold rolled sheet having a thickness of 0.7 mm through annealing of hot rolled sheet (800°–950° C.)—pickling—cold rolling—annealing of cold rolled sheet (800°–950° C.)—pickling. In this case, the cold rolling step of from 4.0 mm→0.7 mm in thickness (total reduction: 82.5%) was divided into a cold rolling stage I (thickness: 4 mm→X mm) and a cold rolling stage II (thickness: X mm→0.7 mm), and the rollings of these stages were carried out under various roll diameter and reduction conditions. A test specimen was taken out from the resulting steel sheet and then subjected to the same tests as in Example 1 for the evaluation of the properties. The results are shown in Table 5 together with the rolling conditions.

TABLE 5

| | Cold rolling condition | | | | Steel No: 1 | | | Steel No: 6 | | |
|---|---|---|---|---|---|---|---|---|---|---|
| | Stage I | | Stage II | | | | | | | |
| Run No | Roll diameter (mm) | Reduction (%) | Roll diameter (mm) | Reduction (%) | r-value | Δr | Crack creating temperature (°C.) | r-value | Δr | Crack creating temperature (°C.) |
| 1 | 80 | 82.5 | — | — | 1.70 | 0.24 | −70 | 1.62 | 0.12 | −75 |
| 2 | 180 | 20.0 | 80 | 78.2 | 1.70 | 0.23 | −70 | 1.63 | 0.11 | −75 |
| 3 | 180 | 35.0 | 80 | 73.1 | 1.81 | 0.12 | −70 | 1.70 | 0.07 | −75 |
| 4 | 180 | 50.0 | 80 | 65.0 | 1.82 | 0.10 | −70 | 1.70 | 0.06 | −75 |
| 5 | 180 | 82.5 | — | — | 1.85 | 0.08 | −75 | 1.71 | 0.05 | −75 |
| 6 | 300 | 35.0 | 80 | 73.1 | 1.75 | 0.13 | −75 | 1.70 | 0.06 | −80 |

As seen from Table 5, all of the steel sheets have more excellent deep-drawing formability and resistance to secondary work brittleness.

INDUSTRIAL APPLICABILITY

As mentioned above, the chromium steel sheets according to the invention have press formability, which has not been obtained in the conventional chromium steel sheet, i.e. excellent deep-drawing formability and resistance to secondary work brittleness, which are useful in the press forming. In the chromium steel sheets according to the invention, therefore, it is possible to conduct severer deep drawing for kitchenwares such as deep drop sinks and the like, automobile parts such as fuel cases and the like, and also it is possible to prevent the occurrence of brittle cracking in subsequent secondary working.

We claim:

1. An iron-chromium steel sheet having excellent press formability consisting essentially of:

C: not more than 0.03 wt %, Si: not more than 1.0 wt %,

Mn: not more than 1.0 wt %, P: not more than 0.05 wt %,

S: not more than 0.015 wt %, Al: not more than 0.10 wt %,

N: not more than 0.02 wt %, Cr: not less than 11 wt % but not more than 60 wt %, Ti: 4(C+N)–0.5 wt %, Nb: 0.003–0.020 wt %, B: 0.0002–0.005 wt %, and the balance being Fe and inevitable impurities.

2. An iron-chromium steel sheet having excellent press formability consisting essentially of:

C: not more than 0.03 wt %, Si: not more than 1.0 wt %,

Mn: not more than 1.0 w %, P: not more than 0.05 wt %,

S: no more than 0.015 wt %, Al: not more than 0.10 wt %,

N: not more than 0.02 wt %, Cr: not less than 11 wt % but not more than 60 wt %, Ti: 4(C+N)–0.5 wt %, Nb: 0.003–0.020 wt %, B: 0.0002–0.005 wt %, Mo: 0.01–5.0 wt %, and the balance being Fe and inevitable impurities.

3. An iron-chromium steel sheet having excellent press formability consisting essentially of:

C: not more than 0.03 wt %, Si: not more than 1.0 wt %,

Mn: not more than 1.0 w %, P: not more than 0.05 wt %,

S: no more than 0.015 wt %, Al: not more than 0.10 wt %,

N: not more than 0.02 wt %, Cr: not less than 11 wt % but not more than 60 wt %, Ti: 4(C+N)–0.5 wt %, Nb: 0.003–0.020 wt %, B: 0.0002–0.005 wt %, Ca: 0.0005–0.01 wt %, and the balance being Fe and inevitable impurities.

4. An iron-chromium steel sheet having excellent press formability consisting essentially of:

C: not more than 0.03 wt %, Si: not more than 1.0 wt %,

Mn: not more than 1.0 w %, P: not more than 0.05 wt %,

S: no more than 0.015 wt %, Al: not more than 0.10 wt %,

N: not more than 0.02 wt %, Cr: not less than 11 wt % but not more than 60 wt %, Ti: 4(C+N)–0.5 wt %, Nb: 0.003–0.020 wt %, B: 0.0002–0.005 wt %, Se: 0.0005–0.025 wt %, and the balance being Fe and inevitable impurities.

5. An iron-chromium steel sheet having excellent press formability consisting essentially of:

C: not more than 0.03 wt %, Si: not more than 1.0 wt %,

Mn: not more than 1.0 w %, P: not more than 0.05 wt %,

S: no more than 0.015 wt %, Al: not more than 0.10 wt %,

N: not more than 0.02 wt %, Cr: not less than 11 wt % but not more than 60 wt %, Ti: 4(C+N)–0.5 wt %, Nb: 0.003–0.020 wt %, B: 0.0002–0.005 wt %, Mo: 0.01–5.0 wt %, Ca: 0.0005–0.01 wt %, and the balance being Fe and inevitable impurities.

6. An iron-chromium steel sheet having excellent press formability consisting essentially of:

C: not more than 0.03 wt %, Si: not more than 1.0 wt %,

Mn: not more than 1.0 w %, P: not more than 0.05 wt %,

S: no more than 0.015 wt %, Al: not more than 0.10 wt %,

N: not more than 0.02 wt %, Cr: not less than 11 wt % but not more than 60 wt %, Ti: 4(C+N)–0.5 wt %, Nb: 0.003–0.020 wt %, B: 0.0002–0.005 wt %, Mo: 0.01–5.0 wt %, Se: 0.0005–0.025 wt %, and the balance being Fe and inevitable impurities.

7. An iron-chromium steel sheet having excellent press formability consisting essentially of:

C: not more than 0.03 wt %, Si: not more than 1.0 wt %,

Mn: not more than 1.0 w %, P: not more than 0.05 wt %,

S: no more than 0.015 wt %, Al: not more than 0.10 wt %,

N: not more than 0.02 wt %, Cr: not less than 11 wt % but not more than 60 wt %, Ti: 4(C+N)–0.5 wt %, Nb: 0.003–0.020 wt %, B: 0.0002–0.005 wt %, Ca: 0.0005–0.01 wt %, Se: 0.0005–0.025 wt %, and the balance being Fe and inevitable impurities.

8. An iron-chromium steel sheet having excellent press formability consisting essentially of:

C: not more than 0.03 wt %, Si: not more than 1.0 wt %,

Mn: not more than 1.0 w %, P: not more than 0.05 wt %,

S: no more than 0.015 wt %, Al: not more than 0.10 wt %,

N: not more than 0.02 wt %, Cr: not less than 11 wt % but not more than 60 wt %, B: 0.0002–0.005 wt %, Mo: 0.01–5.0 wt %, Ca: 0.0005–0.01 wt %, Se: 0.0005–0.025 wt %, Ti: 4(C+N)–0.5 wt %, Nb: 0.003–0.020 wt %, and the balance being Fe and inevitable impurities.

9. An iron-chromium steel sheet according to anyone of claims 2, 5, 6 and 8, wherein Mo content is 0.1–3.0 wt %.

10. An iron-chromium steel sheet according to anyone of claims 1 to 9, wherein a relationship between Ti content and Nb content satisfies $Ti/Nb \geqq 7$.

* * * * *

UNITED STATES PATENT AND TRADEMARK OFFICE

CERTIFICATE OF CORRECTION

PATENT NO. : 5,709,836

DATED : January 20, 1998

INVENTOR(S) : Mitsuyuki Fujisawa; Yasushi Kato; Takumi Ujiro' Susumu Satoh; and Koji Yamato It is certified that error appears in the above-identified patent and that said Letters Patent is hereby corrected as shown below:

Column 1, line 21, please change "severer" to --severe--; line 22, please change "the application" to --applications--; and "casing" to --casings--; line 23, please change "automobile" to --automobiles--; line 41, please change "severer" to --severe--; line 43, please change "severer" to --severe--; and line 58, please change "severer" to --severe--.

Column 2, line 54, please change "anyone" to --any one--.

Column 8, at Table 3, under the sub-heading "Ca", second line, please delete "0.0023".

Signed and Sealed this

Twenty-sixth Day of May, 1998

*Attest:*

Bruce Lehman

BRUCE LEHMAN

*Attesting Officer*

*Commissioner of Patents and Trademarks*